US009379509B2

(12) United States Patent
Guo

(10) Patent No.: US 9,379,509 B2
(45) Date of Patent: Jun. 28, 2016

(54) ELECTRICAL CONNECTOR HAVING A METALLIC SHELL WITH A FLEXIBLE PORTION DEFLECTABLE BY AN EXTRACTION TOOL

(71) Applicant: FOXCONN INTERCONNECT TECHNOLOGY LIMITED, Grand Cayman (KY)

(72) Inventor: Jing-Jie Guo, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/645,998

(22) Filed: Mar. 12, 2015

(65) Prior Publication Data

US 2015/0263473 A1 Sep. 17, 2015

(30) Foreign Application Priority Data

Mar. 12, 2014 (CN) ..... 2014 2 0109570 U

(51) Int. Cl.

| | |
|---|---|
| ***H01R 13/62*** | (2006.01) |
| ***H01R 43/22*** | (2006.01) |
| ***H01R 13/633*** | (2006.01) |
| ***H01R 13/52*** | (2006.01) |
| ***H01R 13/74*** | (2006.01) |

(52) U.S. Cl.

CPC ..... *H01R 43/22* (2013.01); *H01R 13/5202* (2013.01); *H01R 13/633* (2013.01); *H01R 13/743* (2013.01); *Y10T 29/49208* (2015.01)

(58) Field of Classification Search

CPC .... H01R 13/629; H01R 13/633; H01R 13/73; H01R 23/7005

USPC ..... 439/571, 573, 152, 153, 159, 160

See application file for complete search history.

(56) References Cited

U.S. PATENT DOCUMENTS

| | | | | |
|---|---|---|---|---|
| 5,967,812 | A * | 10/1999 | Tung | G06K 13/0806 439/159 |
| 7,033,190 | B1 * | 4/2006 | Chen | G06K 13/0806 439/159 |
| 2006/0089033 | A1 * | 4/2006 | Chen | G06K 13/08 439/159 |
| 2011/0230074 | A1 * | 9/2011 | Schmidt | H01R 13/405 439/271 |
| 2012/0220146 | A1 * | 8/2012 | Yokoyama | G06K 13/0806 439/159 |
| 2015/0188257 | A1 * | 7/2015 | Lin | G06K 13/0812 439/159 |

FOREIGN PATENT DOCUMENTS

| | | |
|---|---|---|
| TW | M385114 | 7/2010 |

* cited by examiner

*Primary Examiner* — Chandrika Prasad

(74) *Attorney, Agent, or Firm* — Ming Chieh Chang; Wei Te Chung

(57) ABSTRACT

An electrical connector (100) includes an insulative housing (10), a number of contacts (11) retained in the insulative housing, and a metal shell (12) covering the insulative housing. Each contact includes a first contacting portion (111) for connecting with a mating plug connector and a second contacting portion (112) for connecting to a board-mounted adapter. The metal shell includes a top wall (121), a bottom wall (122), and a pair of sidewalls (123) connecting between the top wall and the bottom wall for cooperatively defining a receiving space (124). Each sidewall forms a flexible portion (120) for engaging a panel slot (2131). The flexible portion is stamped from the sidewall and the metal shell defines an aperture (125) for communicating with the panel slot. An extraction tool (6) is inserted into the receiving space to deform the flexible portion to detach away from the panel slot.

20 Claims, 7 Drawing Sheets

ELECTRICAL CONNECTOR HAVING A METALLIC SHELL WITH A FLEXIBLE PORTION DEFLECTABLE BY AN EXTRACTION TOOL

BACKGROUND OF THE INVENTION

1. Field of the Invention

The present invention relates generally to an electrical connector, and more particularly to an electrical connector firmly assembled on a panel and conveniently detachable from the panel via an extraction tool.

2. Description of Related Arts

Taiwan Utility Model Pat. No. M385114 issued on Jul. 21, 2010 discloses an electrical connector assembled on a printed circuit board of a panel. The electrical connector comprises an insulative cover and a terminal module received in the insulative cover. The insulative cover has an upper wall, a lower wall, and a pair of sidewalls connecting with the upper wall and the lower wall for defining a receiving channel for the terminal module. The receiving channel has an insertion opening for a mating plug connector's insertion. The upper wall abuts against the printed circuit board. The terminal module comprises an insulative housing, a plurality of signal terminals and a grounding terminal retained in the insulative housing. Each of the signal terminals and the grounding terminal has a spring portion elastically extending towards to and is flexibly connected to the printed circuit board. The insulative housing forms a protrusion at each side edge thereof and the insulative cover defines a notch correspondingly receiving the protrusion for assembling the terminal module into the insulative cover. The signal terminals and the grounding terminal are not soldered on the printed circuit board for conveniently altering either the terminal module or the insulative cover if either the terminal module or the insulative cover is invalid. The utility does not disclose a method how the electrical connector is assembled on the printed circuit board.

An electrical connector firmly assembled on a panel and conveniently detachable from the panel via an extraction tool is desired.

SUMMARY OF THE INVENTION

Accordingly, an object of the present invention is to provide an electrical connector firmly assembled on a panel and conveniently detachable from the panel via an extraction tool.

To achieve the above object, an electrical connector includes an insulative housing, a number of contacts retained in the insulative housing, and a metal shell covering the insulative housing. Each contact includes a first contacting portion for connecting with a mating plug connector and a second contacting portion for connecting to a board-mounted adapter. The metal shell includes a top wall, a bottom wall, and a pair of sidewalls connecting between the top wall and the bottom wall for cooperatively defining a receiving space. Each sidewall forms a flexible portion for engaging a panel slot. The flexible portion is stamped from the sidewall and the metal shell defines an aperture for communicating with the panel slot. An extraction tool is inserted into the receiving space to deform the flexible portion to detach away from the panel slot.

Other objects, advantages and novel features of the invention will become more apparent from the following detailed description when taken in conjunction with the accompanying drawings.

DETAILED DESCRIPTION OF THE PREFERRED EMBODIMENT

Figure 1:
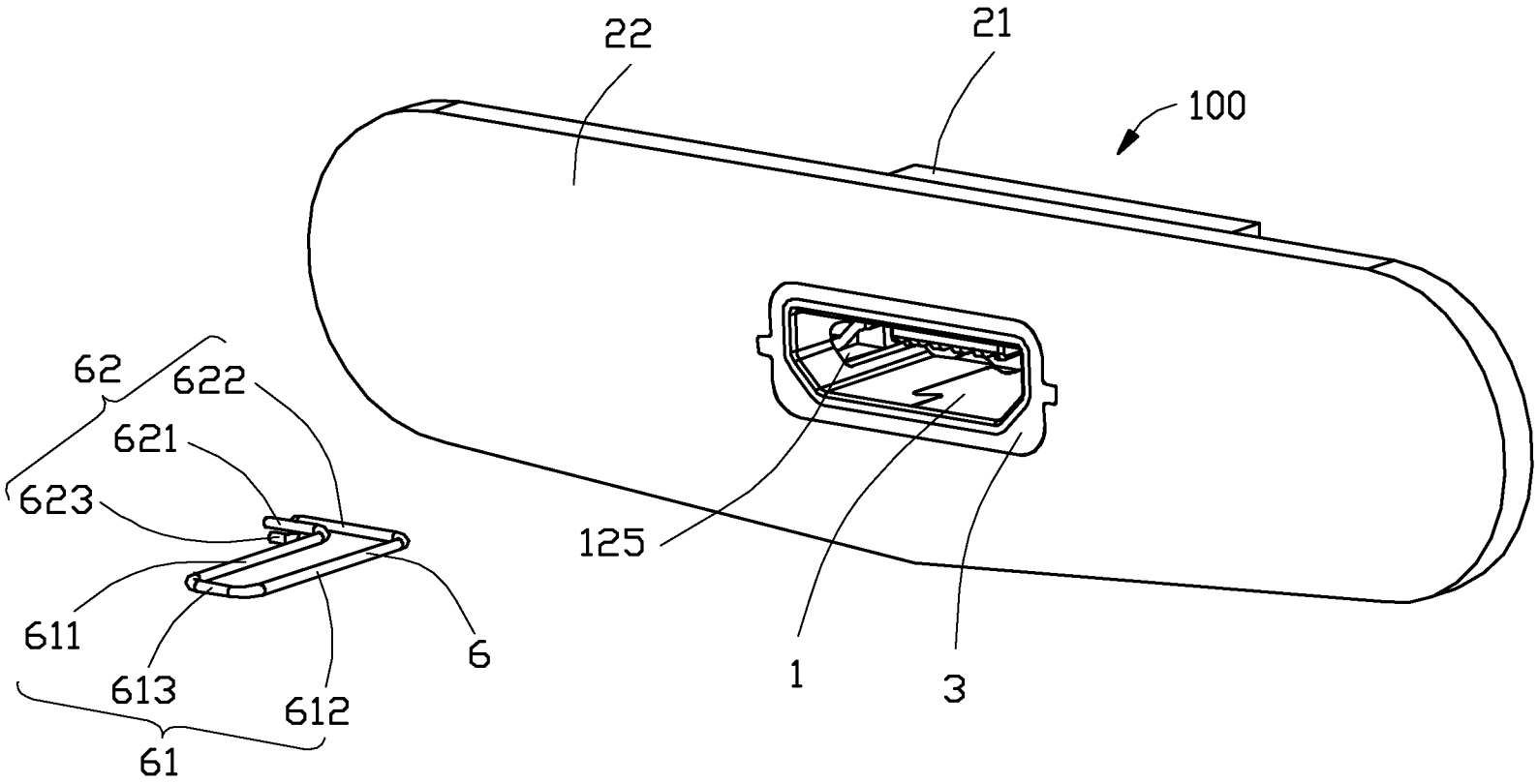
FIG. 1 is a perspective view of a panel having an electrical connector and an extraction tool dissembled away from the panel constructed in accordance with the present invention.

Reference will now be made in detail to the preferred embodiment of the present invention.

Referring to FIGS. 1-7, an electrical connector assembly 100 of the present invention, comprises an electrical connector 1, a panel 2 which the electrical connector 1 is assembled on, and a sealing ring 3 sandwiched between the electrical connector 1 and the panel 2 for waterproof An extraction tool 6 used for withdrawing the electrical connector 1 from the panel 2 is clearly shown in FIGS. 1-7, too. The electrical connector 1 is connected to a printed circuit board 5 via an adapter 4.

Figure 4:
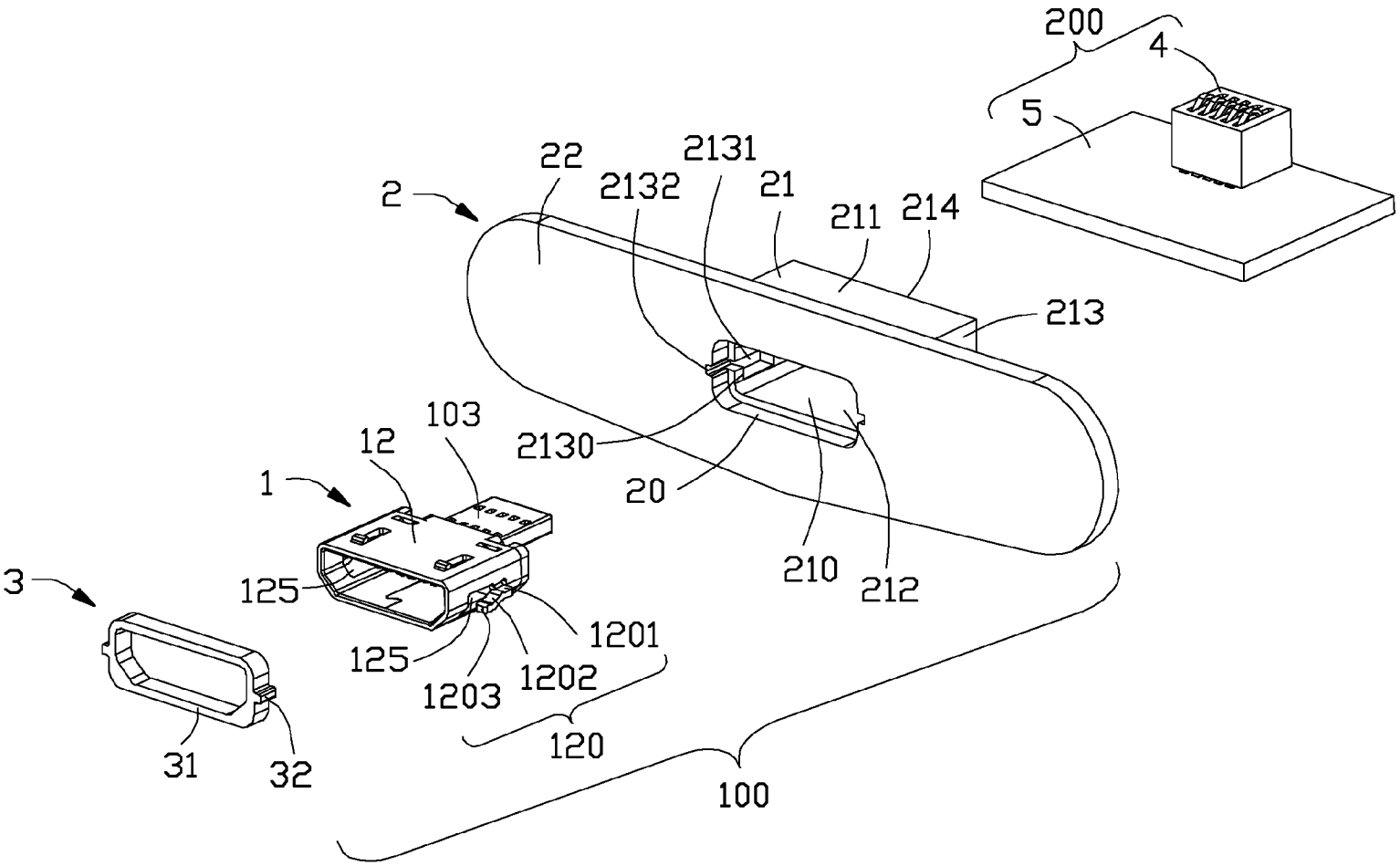
FIG. 4 is a perspective, fully exploded view of FIG. 3.
Figure 5:
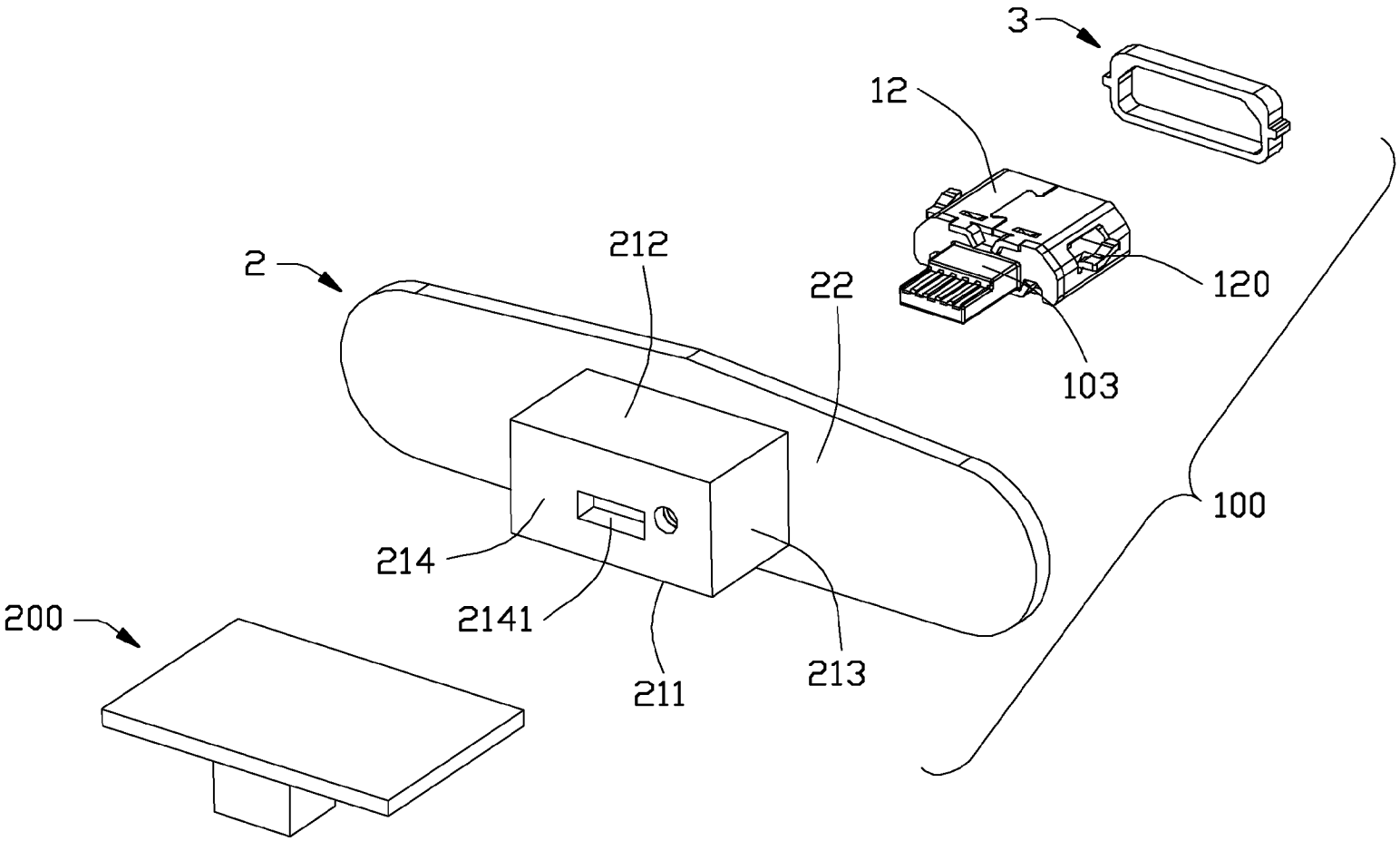
FIG. 5 is similar to FIG. 4, but taken from a different view.
Figure 6:
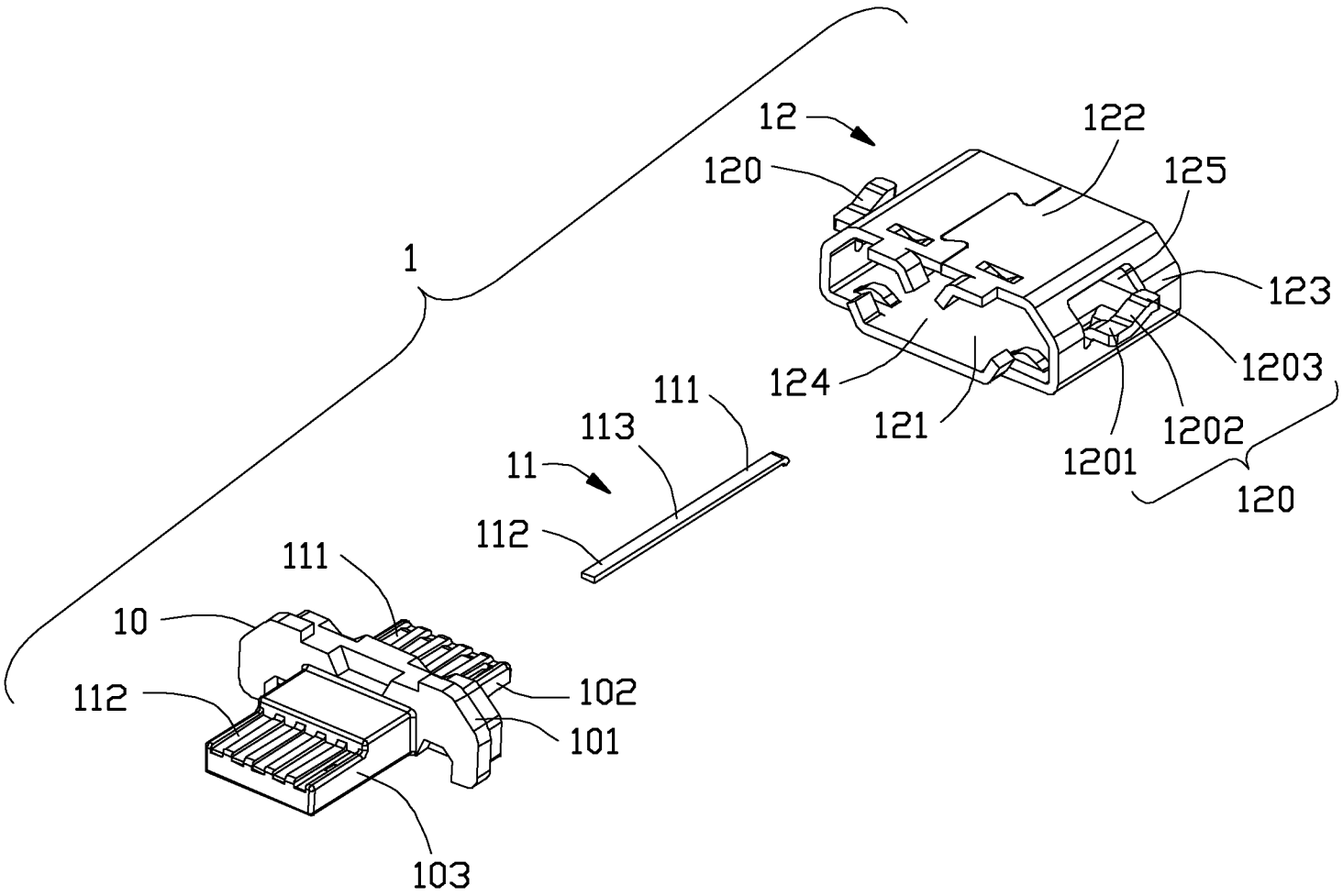
FIG. 6 is a perspective, exploded view of the electrical connector of FIG. 1.
Figure 7:
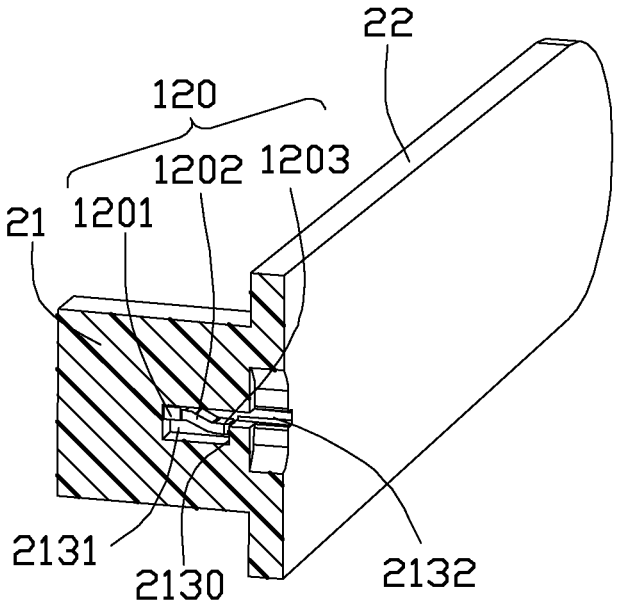
FIG. 7 is a cross-sectional view when taken along line 7-7 of FIG. 3.

Referring to FIGS. 4, 5, 6, the electrical connector 1 comprises an insulative housing 10, a plurality of contacts 11 retained in the insulative housing 10, and a metal shell 12 covering the insulative housing 10 for defining a receiving space 124. The insulative housing 10 comprises a base portion 101, a first tongue portion 102 extending forwardly from the base portion 101, and a second tongue portion 103 extending backwardly from the base portion 101. The first tongue portion 102 and the second tongue portion 103 are positioned at two opposite sides of the base portion 101 for respectively connecting with a mating plug connector (not shown) and the adapter 4.

Referring to FIG. 6, each contact 11 is strip shaped and is stamped from a metal piece. Each contact 11 comprises a first contacting portion 111 partly extending beyond the first tongue portion 102 for connecting with the mating plug connector, a second contacting portion 112 partly extending beyond the second tongue portion 103 for connecting with the adapter 4, and a retaining portion 113 connecting between the first contacting portion 111 and the second contacting portion 112.

Referring to FIGS. 4, 5, 6, the metal shell 12 is stamped from a metal piece, too. The metal shell 12 comprises a top wall 121, a bottom wall 122, and a pair of sidewalls 123 connecting between the top wall 121 and the bottom wall 122. The receiving space 124 is cooperatively defined between the top wall 121, a bottom wall 122, and the sidewalls 123. Each sidewall 123 forms a flexible portion 120. The flexible portion 120 comprises a transverse beam 1201 extending outwardly away from the sidewall 123, a lengthwise beam 1202 forwardly and slantingly extend along a mating direction perpendicular to the transverse beam 1201, and a distal end 1203 formed at the lengthwise beam 1202. In the present embodiment, the lengthwise beam 1202 extends downwardly toward the bottom wall 122. In an alternative embodiment, the lengthwise beam 1202 extending upwardly toward the top wall 121 is all right. Overall, the present invention is emphasized that the transverse beam 1201 and the distal end 1203 are positioned at two different levels along a vertical direction perpendicular to the mating direction.

Referring to FIGS. 1-7, the panel 2 comprises a case portion 21 and a door portion 22 integrally formed at front of the case portion 21. The case portion 21 is used for receiving the electrical connector 1. The case portion 21 has an upper face 211, a lower face 212, a pair of lateral faces 213, and a rear face 214 connecting between the upper face 211, the lower face 212, and the lateral faces 213 for cooperatively defines a receiving room 210 with an insertion opening 20 defined on the door portion 22. Each lateral face 213 defines a panel slot 2131 communicating with the receiving room 210. The door portion 22 defines a guiding slot 2132 formed at each inner side of the insertion opening 20. Therefore, the guiding slot 2132 is formed at front of the panel slot 2131 for guiding the flexible portion 120. The panel 2 forms a block portion 2130 in the panel slot 2131 and below the guiding slot 2132. When the electrical connector 1 is assembled in the panel 2, the flexible portion 120 is guided by the guiding slot 2132 and finally snaps in the panel slot 2131 and therefore, the electrical connector 1 is finally received in the receiving room 210 of the panel 2. The distal end 1203 of the flexible portion 120 abuts against the block portion 2130 for preventing the flexible portion 120 from accidently withdrawing from the panel slot 2131. The rear face 214 defines a slit 2141. The second tongue portion 103 extends out of the receiving room 210 via the slit 2141 for connecting with the adapter 4 and the first tongue portion 102 is positioned adjacent to the insertion opening 20 for connecting with the inserted mating plug connector.

Figure 2:
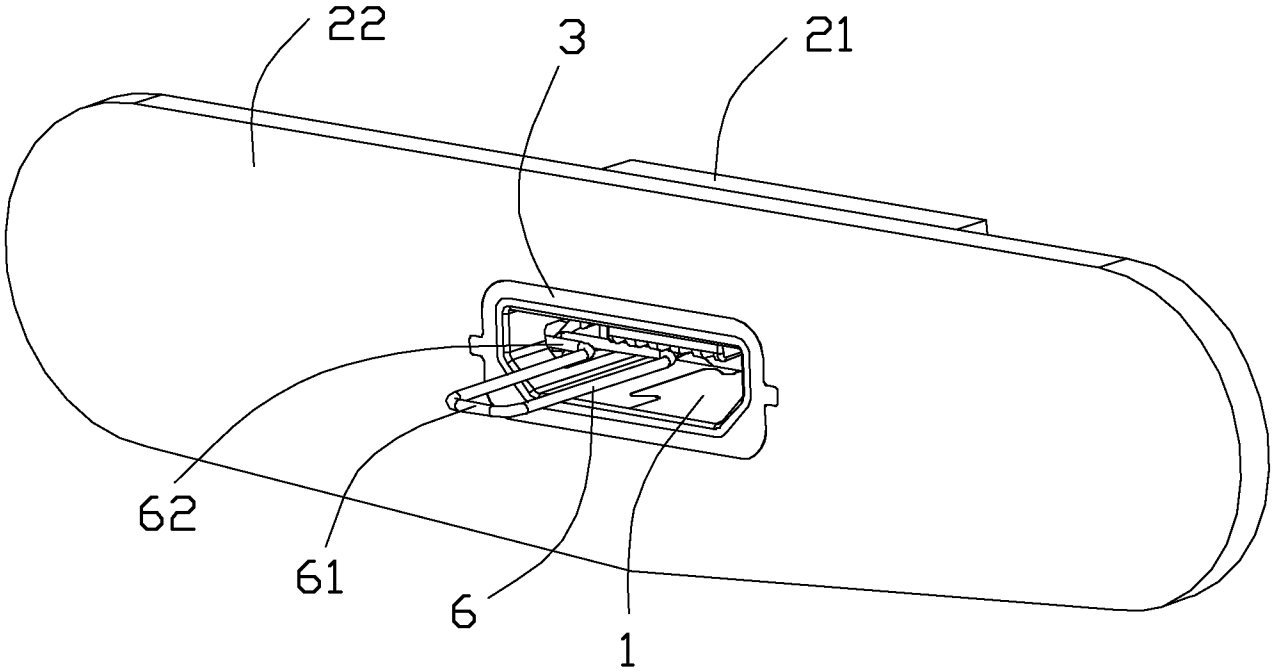
FIG. 2 is a perspective view of the extraction tool being inserted into the panel for separating the electrical connector away from the panel of FIG. 1.
Figure 3:
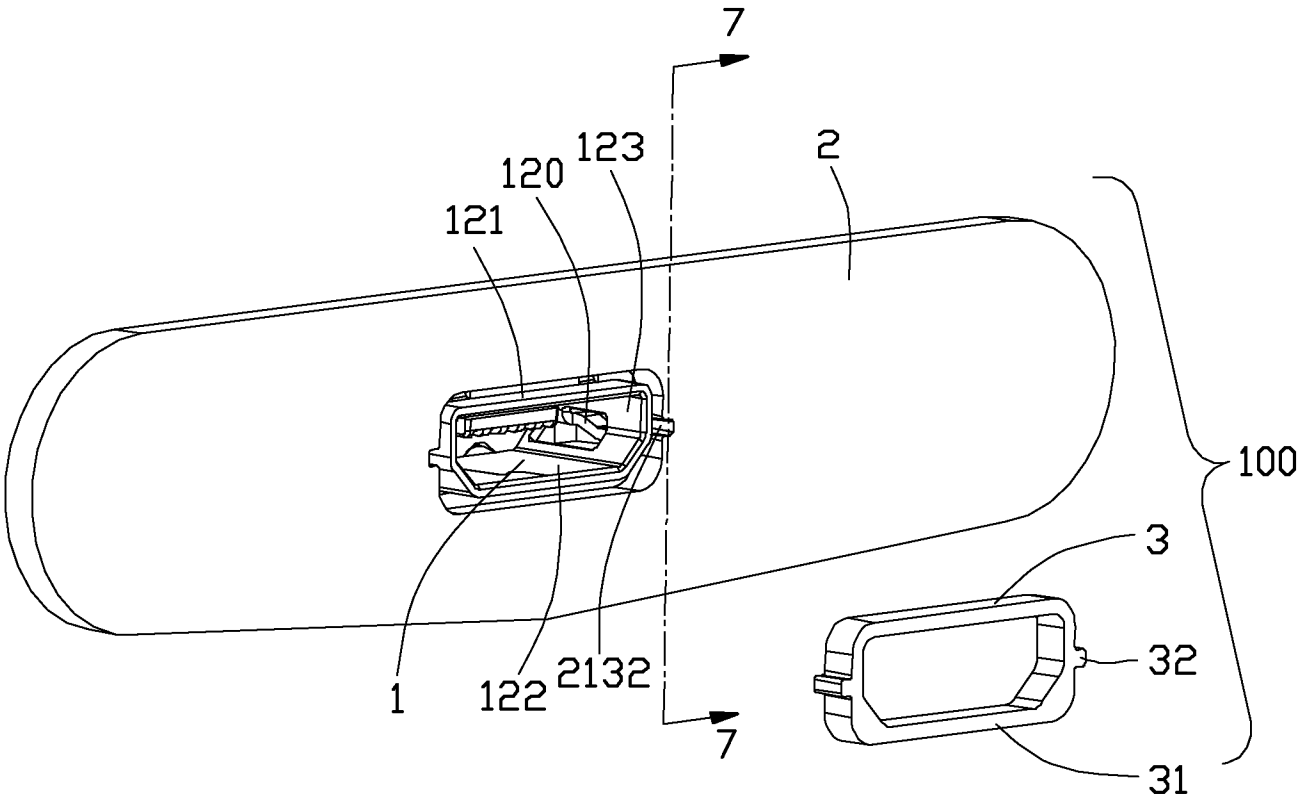
FIG. 3 is a perspective, exploded view of a sealing ring being removed away from the electrical connector and the panel of FIG. 1.

Referring to FIGS. 1-3, the sealing ring 3 is made of resilience material such as Silica gel. The sealing ring 3 comprises a ring portion 31 and a pair of protrusions 32 protruding outwardly from two edges of the ring portion 31. The sealing ring 3 is assembled to the insertion opening 20 of the panel 2 and sandwiched between the panel 2 and the electrical connector 1 for waterproof purpose. The protrusions 32 are filled to the guiding slots 2132 for orientation.

Referring to FIGS. 1, 2, 4 and 6, the flexible portion 120 is stamped from the metal shell 12 and so, the metal shell 12 has defines a corresponding aperture 125 communicating the receiving space 124 with the panel slot 2131 of the panel 2.

Referring to FIGS. 1, 2, 3, and 7, the extraction tool 6 is made from a metal rod. The extraction tool 6 comprises a U-shaped operation portion 61 for facilitating user's operation and a function portion 62 laterally extending from the operation portion 61 for separation between the electrical connector 1 and the panel 2. The operation portion 61 has a first lengthwise arm portion 611, a second lengthwise arm portion 612, and a jointing portion 613 connecting between the first lengthwise arm portion 611 and the second lengthwise arm portion 612. The first lengthwise arm portion 611 and the second lengthwise arm portion 612 are parallel with each other and positioned at the same side of the jointing portion 613. The second lengthwise arm portion 612 is larger than the first lengthwise arm portion 611. The function portion 62 has a first transverse arm 621 bending vertically from the first lengthwise arm portion 611 and a second transverse arm 622 bending vertically from the second lengthwise arm portion 612. A free end portion 623 extends downwardly and forwardly from the second transverse arm 622. The free end portion 623 is positioned in a height lower than that defined by the operation portion 61. The first transverse arm 621 and the second transverse arm 622 are located at a same height that defined by the operation portion 61. The first transverse arm 621 spaces nearer to the jointing portion 613 than the second transverse arm 622.

Referring to FIGS. 1, 2, 3, and 7, when the electrical connector 1 is invalid for requiring replacement, a user utilizes the extraction tool 6 to withdraw the electrical connector 1 out of the panel 2. In detail, the extraction tool 6 is inserted into the receiving space 124 of the electrical connector 1 to make sure that the function portion 62 extends into the panel slot 2130 via the aperture 125. Therefore, the free end portion 623 extends below the flexible portion 120 to raise the flexible portion 120. Therefore, the distal end 1203 of the flexible portion 120 detaches away from the block portion 2130 of the panel slot 2131. Because the contacting portions 112 connect with the adapter 4 without a soldering process, the user is effortlessly pulls the electrical connector 1 out of the panel 2 along an ejection direction for replacement when the first transverse arm 621 snaps with the metal shell 12.

The flexible portion 120 snaps in the panel slot 2131 for guaranteeing stabilization of the electrical connector 1 with respect to the panel 2 in normal use. The electrical connector 1 is not soldered to the printed circuit board 5 but only connects with the printed circuit board 5 via the adapter 4 for facilitating withdrawing the electrical connector 1 out of the panel 2. Because the extraction tool 6 is directly inserted in to the receiving space 124 of the electrical connector 1 for unlocking the flexible portion 120 and the panel slot 2131, it is not required for removing the sealing ring 3 sandwiched between the electrical connector 1 and the panel 2 before drawing out of the electrical connector 1.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly comprising:

an insulative housing;

a plurality of contacts retained in the insulative housing, each contact comprising a first contacting portion for connecting with a mating plug connector and a second contacting portion for connecting to a board-mounted adapter;

a metal shell covering the insulative housing, the metal shell comprising a top wall, a bottom wall, and a pair of sidewalls connecting between the top wall and the bottom wall for cooperatively defining a receiving space, each sidewall forms a flexible portion for engaging a panel slot, wherein the flexible portion is stamped from the sidewall and the metal shell defines an aperture for communicating with the panel slot; and an extraction tool for being inserted into the receiving space to deform the flexible portion to detach away from the panel slot.

2. The electrical connector assembly as claimed in claim 1, wherein the flexible portion comprises a transverse beam extending outwardly away from the sidewall and a lengthwise beam forwardly extending along a mating direction perpendicular to the transverse beam.

3. The electrical connector assembly as claimed in claim 2, wherein the lengthwise beam extends slantingly from the transverse beam so that the transverse beam and a distal end of the lengthwise beam are positioned at two different levels along a vertical direction perpendicular to the mating direction.

4. The electrical connector assembly as claimed in claim 3, wherein the panel slot has a block portion abutting against the distal end of the flexible portion.

5. The electrical connector assembly as claimed in claim 1, wherein the extraction tool comprises an operation portion for facilitation operation and a function portion laterally extending from the operation portion into the panel slot via the aperture.

6. The electrical connector assembly as claimed in claim 5, wherein the function portion comprises a free end portion extending below the flexible portion to raise the flexible portion and a first transverse arm snapping with the metal shell for drawing.

7. The electrical connector assembly as claimed in claim 6, wherein the operation portion comprises a first lengthwise arm portion, a second lengthwise arm portion, and a jointing portion connecting between the first lengthwise arm portion and the second lengthwise arm portion, and wherein the first transverse arm bends vertically from the first lengthwise arm portion and the free end portion extends from a second transverse arm bending vertically from the second lengthwise arm portion.

8. The electrical connector assembly as claimed in claim 7, wherein the first lengthwise arm portion and the second lengthwise arm portion are parallel with each other and positioned at the same side of the jointing portion and wherein the first transverse arm spaces nearer to the jointing portion than the second transverse arm.

9. The electrical connector assembly as claimed in claim 8, wherein the free end portion is positioned in a height lower than that defined by the operation portion.

10. The electrical connector assembly as claimed in claim 7, wherein the second lengthwise arm portion is larger than the first lengthwise arm portion.

11. The electrical connector assembly as claimed in claim 7, wherein the first transverse arm and the second transverse arm are located at a same height that defined by the operation portion.

12. A method of assembling/disassembling an electrical connector with regard to a metallic panel, comprising steps of:

providing the metallic panel with a case portion having a receiving room, and a door portion having a receiving opening in front of said case portion in a front-to-back direction;

providing the electrical connector with an insulative housing securely enclosed in a metallic shell wherein said shell defines a mating port and said electrical connector is adapted to be inserted into the receiving room via said receiving opening;

providing said shell with a flexible portion which is engaged with the panel when said electrical connector is received within the receiving room; and providing a sealing ring upon and around the shell to seal a circumferential gap between the shell and the panel around said receiving opening; wherein during removal of said electrical connector from the panel, said flexible portion is deflected by an external tool, which is inserted into the mating port from an exterior, so as to be disengaged from the panel and have the whole electrical connector accompanied with the sealing ring and removed from the panel.

13. The method as claimed in claim 12, wherein the tool includes a function portion having a first arm to move the flexible portion from a locked position to a released position, and a second arm imposing forces upon the shell to withdraw the electrical connector backwardly from the panel.

14. The method as claimed in claim 12, wherein said flexible portion is deflectable in a vertical direction perpendicular to the front-to-back direction.

15. The method as claimed in claim 14, wherein said flexible portion located beside a side wall of the shell in a transverse direction perpendicular to both said front-to-back direction and said vertical direction.

16. An electrical connector assembly comprising:

a metallic panel with a case portion having a receiving room, and a door portion having a receiving opening in front of said case portion in a front-to-back direction;

an electrical connector configured and dimensioned to be received within the receiving room via said receiving opening and including:

an insulative housing fixedly enclosed in a metallic shell;

a mating port formed in the shell;

a flexible portion unitarily formed with the shell; and a sealing ring positioned upon and around the shell to seal a circumferential gap between the shell and the panel around said receiving opening; wherein said flexible portion is adapted to be engaged with the panel when said electrical connector is received within the receiving room while is adapted to be deflected by an external tool, which is inserted into the mating port from the receiving opening, to be disengaged from the panel so as to have the electrical connector withdrawn from the panel via said tool.

17. The electrical connector assembly as claimed in claim 16, wherein said flexible portion is moved to a position behind the sealing ring in said front-to-back direction.

18. The electrical connector assembly as claimed in claim 17, where said door portion forms a slot beside the receiving opening to allow said flexible portion to move therefrom.

19. The electrical connector assembly as claimed in claim 18, wherein said sealing ring includes a protrusion to be received within the slot.

20. The electrical connector assembly as claimed in claim 16, wherein said shell includes a transverese opening to allow said tool to reach the flexible portion from the mating port.

* * * * *